US006142896A

United States Patent [19]

Simo et al.

[11] Patent Number: 6,142,896

[45] Date of Patent: Nov. 7, 2000

[54] QUICKSPIN ARCHERY VANE

[75] Inventors: Miroslav A. Simo, Riverside; Robert S. Mizek; Frank A. Harwath, both of Downers Grove, all of Ill.

[73] Assignee: New Archery Products Corp., Forest Park, Ill.

[21] Appl. No.: 09/470,370

[22] Filed: Dec. 22, 1999

[51] Int. Cl.[7] ..... F42B 6/06

[52] U.S. Cl. ..... 473/586

[58] Field of Search ..... 473/578, 585, 473/586, FOR 216, FOR 220, FOR 223

[56] References Cited

U.S. PATENT DOCUMENTS

| | | | |
|---|---|---|---|
| 2,830,818 | 4/1958 | Otto | 473/586 |
| 3,749,403 | 7/1973 | Austin et al. | 473/586 |
| 4,583,745 | 4/1986 | Ladner | 473/586 |
| 5,024,448 | 6/1991 | Barrie | 473/586 |
| 5,427,385 | 6/1995 | Conrad et al. . | |
| 5,443,273 | 8/1995 | Lovorn . | |
| 5,465,981 | 11/1995 | Klaus . | |
| 5,613,688 | 3/1997 | Carella | 473/586 |
| 5,842,942 | 12/1998 | Doht et al. | 473/578 |
| 5,846,147 | 12/1998 | Basik | 473/578 |
| 5,871,410 | 2/1999 | Simo et al. | 473/583 |
| 5,897,449 | 4/1999 | Roberts et al. | 473/586 |

FOREIGN PATENT DOCUMENTS

| | | | |
|---|---|---|---|
| 779616 | 7/1957 | United Kingdom | 473/FOR 223 |
| 2166059 | 4/1986 | United Kingdom | 473/FOR 223 |
| 2211430 | 7/1989 | United Kingdom | 473/FOR 223 |

*Primary Examiner*—John A. Ricci
*Attorney, Agent, or Firm*—Pauley Petersen Kinne & Fejer

[57] ABSTRACT

An archery vane having a first side with a first surface and an opposing second side with a second surface, the second surface having a roughness greater than the roughness of the first surface. A projection is attached to the first surface. The archery vanes generate rotation of the arrow shaft about its spin axis to provide increased stability of the arrow shaft and improved flight accuracy of the arrow. Arrows having such archery vanes are easily and efficiently manufactured due to the position of the archery vanes on the arrow shaft generally parallel to the spin axis.

15 Claims, 6 Drawing Sheets

QUICKSPIN ARCHERY VANE

BACKGROUND OF THE INVENTION

1. Field of the Invention

This invention relates to an archery vane having a first side and an opposing second side, the second side having a roughness greater than the roughness of the first side, to generate rotation of an arrow shaft about its longitudinal axis, to increase rotation and stability of the arrow shaft, and to improve flight accuracy.

2. Description of Related Art

Conventional archery vanes have two similar opposing surfaces. Such archery vanes do not affect rotation during arrow flight resulting in poor arrow shaft stability and poor arrow flight accuracy.

In an effort to increase rotation of the arrow, conventional vanes are attached to the arrow shaft in a helical orientation with respect to the longitudinal axis of the arrow shaft. The helical orientation of the archery vanes generates more rotation during flight than other conventional archery vanes. However, due to the decreased clearance between archery vanes, the archery vanes interfere with an arrow rest of a bow, for example as the arrow is shot. This interference causes the arrow to change direction as it is shot from the bow or wobble during flight, resulting in decreased accuracy and flight distance. Further, because of a required offset position arrows having helically oriented archery vanes are difficult to manufacture.

Other conventional archery vanes have a surface with a convex shape producing an airfoil-type archery vane to generate rotation. However, the convex surface produces only a small amount of fluid displacement and relatively little rotation of the arrow during flight. Thus, these conventional archery vanes do not provide the desired rotation and stability to the arrow.

There is an apparent need for an archery vane which generates enough rotation of the arrow shaft about a longitudinal axis to provide increased rotation and increased stability to the arrow shaft and improve flight accuracy of the arrow.

It is also apparent that there is a need for an archery vane that can be positioned along the arrow shaft parallel with respect to the longitudinal axis of the arrow shaft, to simplify manufacturing of arrows while providing enhanced aerodynamic flight.

SUMMARY OF THE INVENTION

It is an object of this invention to provide an archery vane having a first surface with a projection and a second surface, which opposes the first surface, having a greater roughness than the first surface to rotate the arrow shaft about a longitudinal axis or its spin axis, to increase rotation and stability of the arrow shaft, and to improve arrow flight accuracy.

It is another object of this invention to provide an archery vane that is attachable to an arrow shaft in a position which is parallel to the spin axis of the arrow shaft, to significantly simplify the manufacturing process.

The above and other objects of this invention are accomplished with an archery vane attached to an arrow shaft in a position which is generally parallel to a longitudinal axis or spin axis of the arrow shaft. The generally parallel position of the archery vanes provides maximum clearance between the archery vanes and the arrow rest, for example when the arrow is mounted within a bow.

The archery vane has a first side with a first surface and an opposing second side with a second surface. The first side and the second side are preferably but not necessarily mirror image sides having a first surface area and a second surface area, respectively, within a defined boundary. In one preferred embodiment of this invention, the first surface area and the second surface area are equal. The first surface can have a first surface roughness which is generally planar and smooth. The second surface can be generally planar and have a second surface roughness, preferably greater than the first surface roughness.

In one preferred embodiment of this invention, the second surface has a plurality of surface irregularities that form the second surface roughness. Only a portion of the second surface or substantially all of the second surface may comprise surface irregularities. The degree to which the second surface is covered with irregularities may be a function of various design factors, such as the type or shape of irregularities, the material used to produce the archery vanes, the desired roughness of the surfaces and/or the desired aerodynamic effect upon the flight characteristics of the arrow.

The irregularities forming the surface roughness may comprise a plurality of microgrooves, a multiplicity of dimples forming depressions or microdepressions, protuberances, pores, stippling, knurling and/or particulates that form a non-directional pattern.

The irregularities forming the surface roughness may be formed by a process, such as but not limited to extrusion, injection molding, machine cutting and/or chemical etching. The irregularities may vary in size and shape so long as a second totally exposed surface area of the second surface is greater than a first totally exposed surface area of the first surface.

Regardless of the manner in which the irregularities are produced or otherwise achieved, one intended result of this invention is for the irregularities to form a surface roughness to break-up, interrupt or cause turbulence within or near a boundary layer of fluid flow passing the archery vanes while the arrow is in flight.

During arrow flight, the roughened second surface of each archery vane disturbs or interferes with the fluid flow of air past the archery vanes. The boundary layer of fluid is disturbed as it passes over the second surface, creating a turbulent flow and a lift force that acts on the second surface of each archery vane. The lift force exerted on the second surface of each archery vane generates rotation of the arrow shaft about its spin axis. Generated angular momentum increases rotation and stability of the arrow shaft about the spin axis and improves arrow flight accuracy.

A projection, for example a kicker element, is attached to at least a portion of the first side of the archery vane or arranged along at least a portion of a periphery of the archery vane to increase rotation and further stabilize the arrow shaft about the spin axis.

BRIEF DESCRIPTION OF THE DRAWINGS

The drawings show different features of an archery vane according to preferred embodiments of this invention, wherein.

DETAILED DESCRIPTION OF THE PREFERRED EMBODIMENTS

Figure 1:
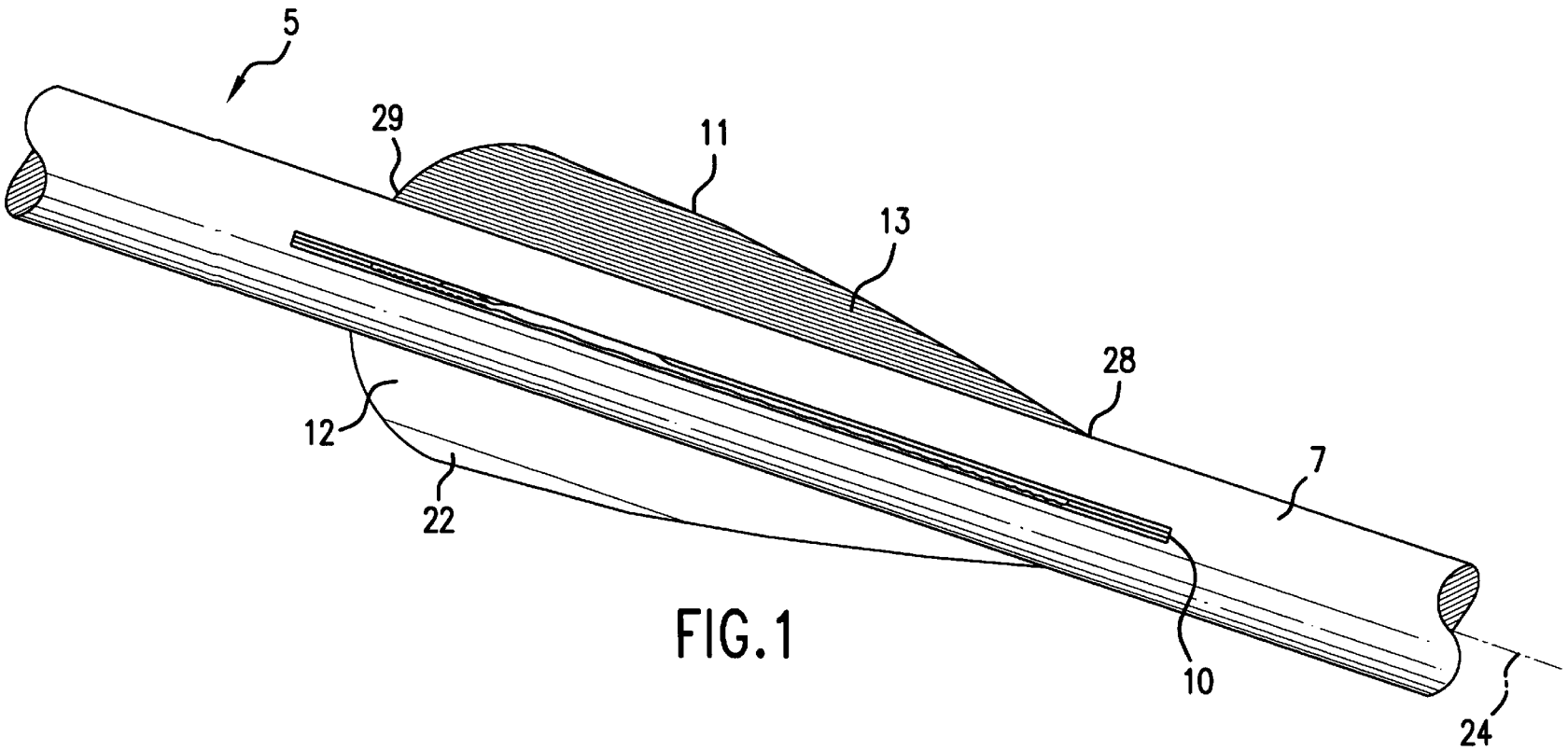
FIG. 1 is a perspective side view of a portion of an arrow having a plurality of archery vanes attached to an arrow shaft in a circumferential relation on an outer surface of the arrow shaft, according to one preferred embodiment of this invention.

Referring to FIG. 1, an arrow 5 comprises an arrow shaft 7 and a plurality of archery vanes 10. Preferably but not necessarily, three archery vanes 10 are positioned on or attached to arrow shaft 7 in a circumferential relation on an outer surface of arrow shaft 7. In one preferred embodiment of this invention, three archery vanes 10 are positioned equally about the circumference of arrow shaft 7, i.e. each archery vane 10 is positioned 120° from each of the two other archery vanes 10. It is apparent to one skilled in the art that more or less than three archery vanes 10 can be positioned about or on arrow shaft 7.

In one preferred embodiment of this invention, archery vanes 10 are positioned about or on arrow shaft 7 generally parallel to a longitudinal axis or spin axis 24 of arrow shaft 7. Archery vanes 10 can be positioned along arrow shaft 7 in a left or right helical orientation. In such an orientation, archery vanes 10 are offset with respect to spin axis 24. However, in order to provide maximum clearance between archery vanes 10 and the arrow rest when arrow 5 is mounted within a bow, in the preferred embodiments of this invention, archery vanes 10 are positioned generally parallel to spin axis 24 as shown in FIG. 1. Thus, there is no adverse interference with respect to any other archery component, including the arrow rest, when mounting arrow 5 of this invention within the bow. Further, arrow 5 having a plurality of archery vanes 10 mounted on arrow shaft 7 and generally parallel to spin axis 24 is much easier to manufacture than conventional arrows having a plurality of archery vanes positioned in a helical configuration about an arrow shaft.

Figure 2:
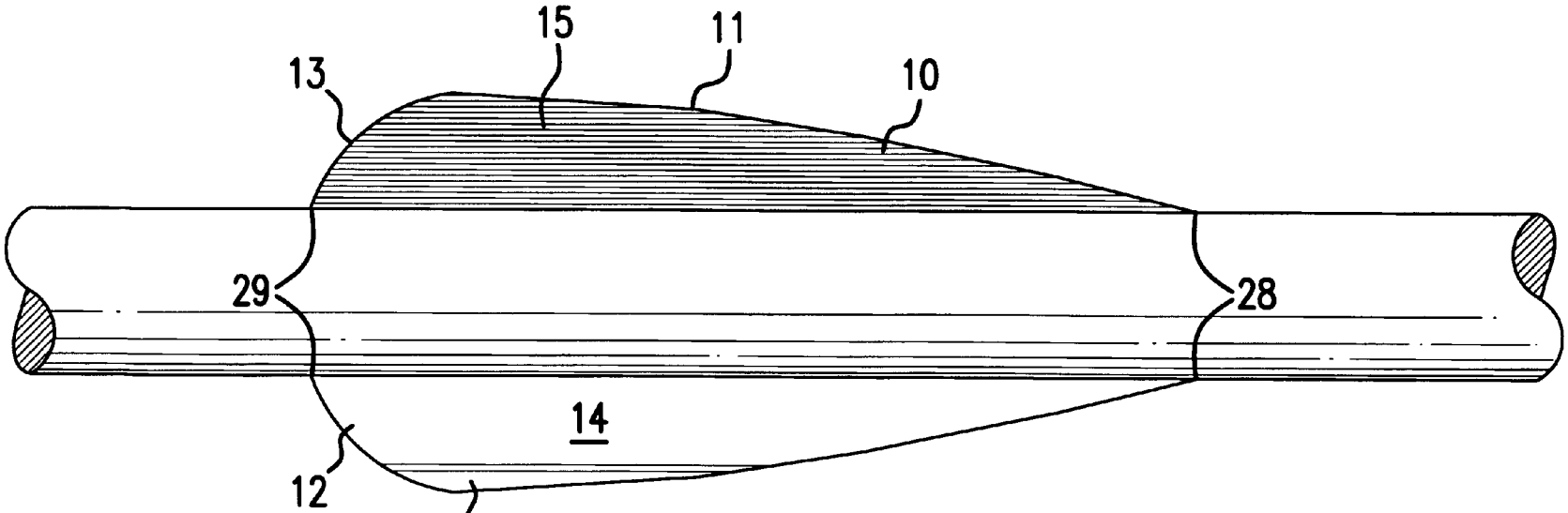
FIG. 2 is a side view of an archery vane showing a first side of the archery vane having a first surface area within a defined boundary and an opposing second side of the archery vane having a second surface area within the defined boundary.

As shown in FIG. 2, archery vane 10 has a leading portion 28 and a trailing portion 29. Archery vane 10 generally has a defined boundary 11 as shown in FIG. 2 or can have any other suitable defined boundary 11 similar to a shape of any conventional vane that provides acceptable aerodynamic flight characteristics.

Archery vane 10 further comprises a first side 12 having a first surface 14 and an opposing second side 13 having a second surface 15. As shown in FIG. 2, first side 12 and second side 13 are mirror image sides having a first surface area and a second surface area, respectively, within defined boundary 11, i.e. the first surface area is equal to the second surface area. First surface 14 has a first surface roughness. Preferably but not necessarily, first surface 14 is generally planar and smooth. Second surface 15 is generally planer and has a second surface roughness. Preferably, the second surface roughness is greater than the first surface roughness.

As shown in FIGS. 3*a*–3*d*, at least a portion of second surface 15 has a plurality of surface irregularities that form the second surface roughness. In certain preferred embodiments of this invention, the overall pattern of the irregularities repeats in a generally consistent fashion and can be a function of desired dimensions and shapes.

The irregularities are intended to form a particular overall or average surface roughness, preferably a particular second surface roughness of second surface 15. The term roughness refers to a relatively finely spaced surface texture, for example which can be a product of a particular manufacturing process or which can result from a cutting action of tools or abrasive grains. The term flaws refers to surface imperfections that occur at relatively infrequent intervals. Flaws are normally caused by nonuniformity of the material or are the result of damage to the surface subsequent to processing. Flaws typically include scratches, dents, pits and/or cracks and should not be considered irregularities that form the surface roughness contemplated by certain preferred embodiments of this invention. Roughness formed by irregularities as used in this specification and in the claims is intended to relate to a surface quality which is a product of a process and should not be confused or interchangeable with surface flaws.

In one preferred embodiment of this invention, only a portion of second surface 15 comprises irregularities. In another preferred embodiment according to this invention, such as shown in FIGS. 3*a*–3*d*, second surface 15 is substantially covered with irregularities. The degree to which second surface 15 is covered with irregularities may be a function of various design factors, such as the type or shape of irregularities, the material used to produce archery vanes 10, the desired roughness of surfaces 14 and 15 and/or the desired rotational effect or aerodynamic effect upon the flight characteristics of arrow 5.

Figure 3A:
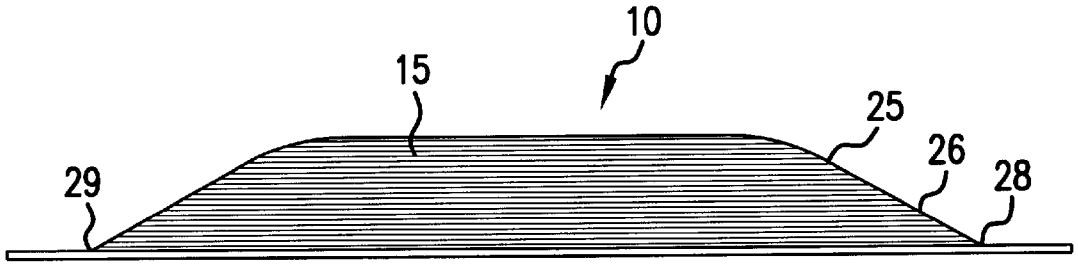
FIG. 3*a* is a side view of a second surface of a symmetrical archery vane with a plurality of parallel microgrooves, according to one preferred embodiment of this invention.
Figure 3B:
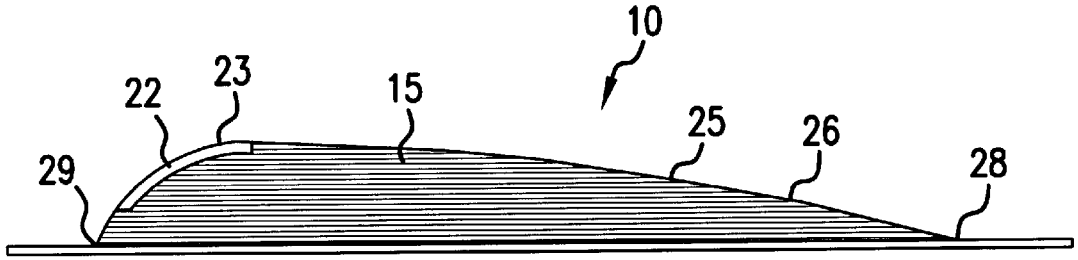
FIG. 3*b* is a side view of a second surface of an archery vane with a plurality of parallel microgrooves and a kicker element, according to one preferred embodiment of this invention.

In one preferred embodiment of this invention, the irregularities forming the second surface roughness of second surface 15 comprise a plurality of adjacent lands 25 and grooves 26 which form microgrooves covering at least a portion of second surface 15, as shown in FIGS. 3*a* and 3*b*. Preferably, lands 25 and grooves 26 extend in a longitudinal direction from leading portion 28 to trailing portion 29 on second surface 15, such as generally parallel to each other and to longitudinal axis or spin axis 24 of arrow shaft 7. Microgrooves range in depth from about 0.005 inch to about 0.015 inch. In another preferred embodiment of this invention, lands 25 and grooves 26 are positioned at an angle with respect to each other to produce a plurality knurls. For example, lands 25 and grooves 26 can crisscross each other to form any suitably shaped apex.

In one preferred embodiment of this invention, a projection 22, for example kicker 22, is attached to at least a portion of first side 12 of archery vane 10, as shown in FIGS.

2 and 5. Projection 22 is attached to first side 12 during or after manufacture of archery vane 10. In another preferred embodiment of this invention, projection 22 is arranged along at least a portion of a periphery 23 of archery vane 10, as shown in FIG. 3*b*.

Figure 3C:
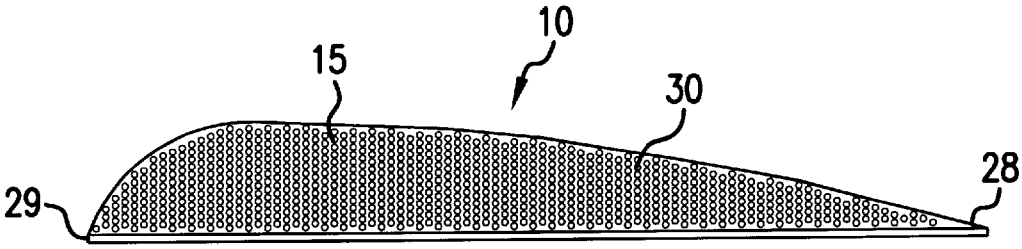
FIG. 3*c* is a side view of a second surface of an archery vane with circular microdepressions, according to one preferred embodiment of this invention.
Figure 3D:
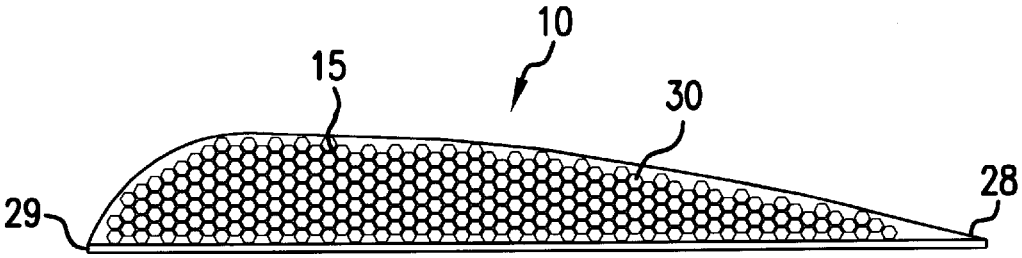
FIG. 3*d* is a side view of a second surface of an archery vane with hexagonal microdepressions, according to one preferred embodiment of this invention.

In one preferred embodiment of this invention, the irregularities forming the second surface roughness of second surface 15 comprise a multiplicity of dimples 30 covering at least a portion of second surface 15, as shown in FIGS. 3*c* and 3*d*. Dimples 30 can be formed by raised surfaces and/or indented surfaces. Dimples 30 may have a generally circular cross-section forming circular microdepressions, as shown in FIG. 3*c*, or dimples 30 may have a generally polygonal cross-section, for example a hexagonal cross-section forming hexagonal microdepressions, as shown in FIG. 3*d*.

In one preferred embodiment of this invention, first surface 14 and/or second surface 15 are convex, forming an airfoil-type archery vane 10. In such an embodiment, second surface 15 may be rougher than first surface 14. In another preferred embodiment of this invention, first side 12 with first surface 14 and/or second side 13 with second surface 15 may comprise a bottom portion having a greater thickness than a top portion, forming an airfoil-type archery vane 10 with a profile. Preferably, a second totally exposed surface area of second surface 15 is greater than a first totally exposed surface area of first surface 14.

Figure 4A:
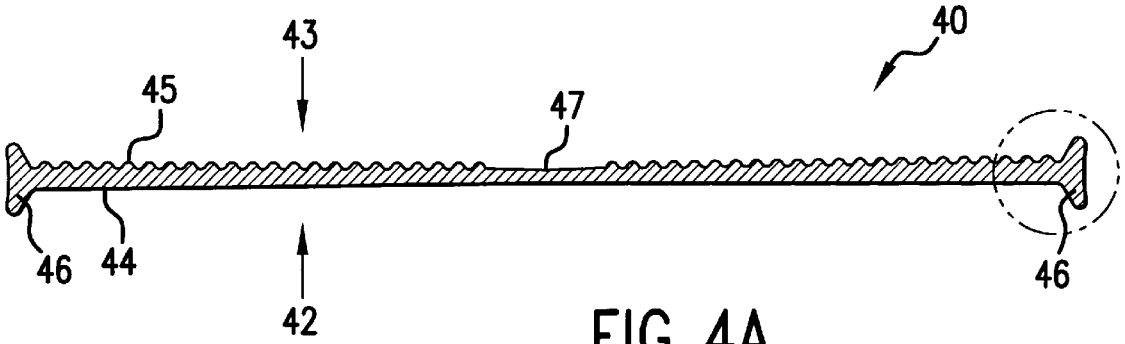
FIG. 4*a* is a cross-sectional view of a ribbon, produced by an extrusion process used to produce the archery vanes, according to one preferred embodiment of this invention.
Figure 4B:
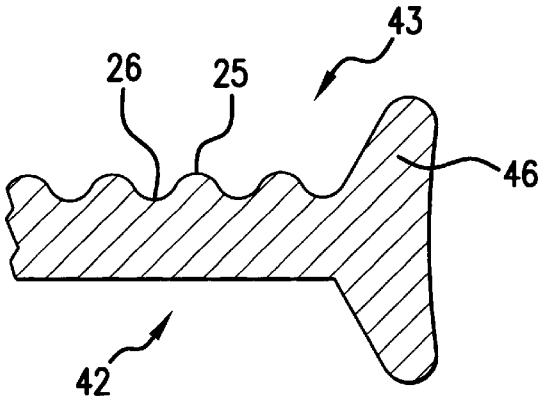
FIG. 4*b* is an exploded cross-sectional view of a circled portion, as shown in FIG. 4*a*, of the ribbon showing a base of an archery vane and the second surface roughness.
Figure 5:
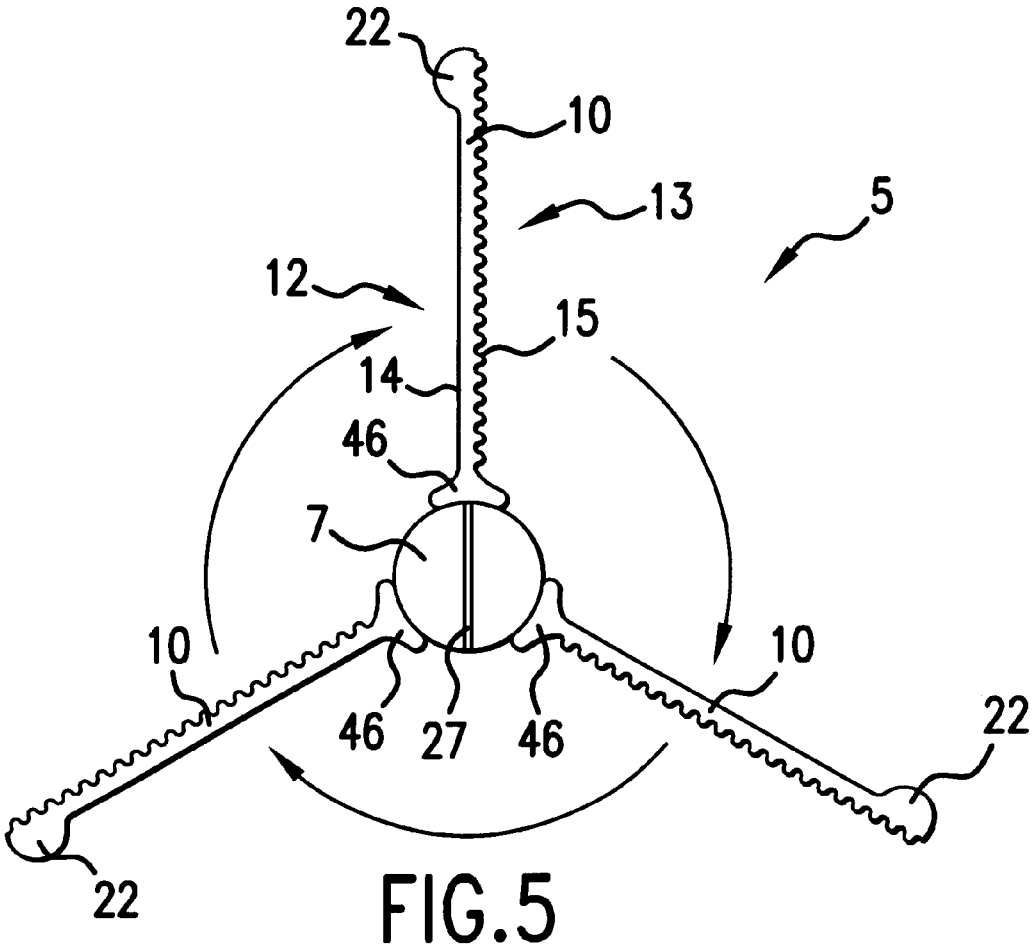
FIG. 5 is an enlarged back view of an arrow having a plurality of archery vanes, showing a rotation direction of the arrow shaft during arrow flight, according to one preferred embodiment of this invention.

In certain preferred embodiments of this invention, archery vanes 10 are produced from an extrusion process wherein the extrusion process forms an I-beam structure or ribbon 40, for example about 100 feet to about 200 feet in length, having a generally planar first side 42 having a smooth first surface 44 and a generally planar second side 43 having a roughened second surface 45. For example, roughened second surface 45 may comprise a plurality of parallel lands 25 and grooves 26 forming microgrooves, as shown in FIG. 4*a* and 4*b*. Ribbon 40 preferably comprises two opposing bases 46. Each opposing base 46 eventually will form a base 46 of an individual archery vane 10. Ribbon 40 is then placed in a press and heated to a molten temperature and at least one kicker 22, preferably two or more kickers 22, such as shown in FIG. 5, are formed on first surface 44 in a runner area 47 of ribbon 40. Ribbon 40 is heated by an apparatus or process known to those skilled in the art, for example by a heating element or by ultrasonic techniques. Once one or more kickers 22 are formed, ribbon 40 is cut into two laterally opposing archery vanes 10 having smooth first surface 14 with kicker 22 and second surface 15 with the second surface roughness. Ribbon 40 is cut into archery vanes 10 using means known to those skilled in the art, for example a die. Such extrusion process allows any variety of archery vanes 10 to be produced having varying size, length and/or profile.

In preferred embodiments of this invention, the irregularities forming the first surface roughness and the second surface roughness may vary in size and shape so long as the second totally exposed surface area of second surface 15 is greater than the first totally exposed surface area of first surface 14. Totally exposed surface area as used throughout this specification and in the claims is defined as the total surface area, uniform or variable, of a surface within the defined boundary including the surface area of surface irregularities that form a surface roughness.

In certain preferred embodiments of this invention, the irregularities forming the second surface roughness are formed by a process, such as but not limited to machine cutting, injection molding, and/or chemical etching, that produces pits, protuberances, pores, stippling, knurling and/or particulates that form a non-directional pattern. In still another preferred embodiment of this invention, the irregularities are formed by a process that produces a surface roughness with a multi-directional pattern. It is also possible to form irregularities with epoxy, paint or any other suitable material or process which can be used to produce the irregularities.

Regardless of the manner in which the irregularities are produced or otherwise achieved, one intended result is for the irregularities to form a surface roughness to break-up, interrupt or cause turbulence within or near a boundary layer of fluid flow passing archery vanes 10, such as when arrow 5 is in flight.

Figure 6:
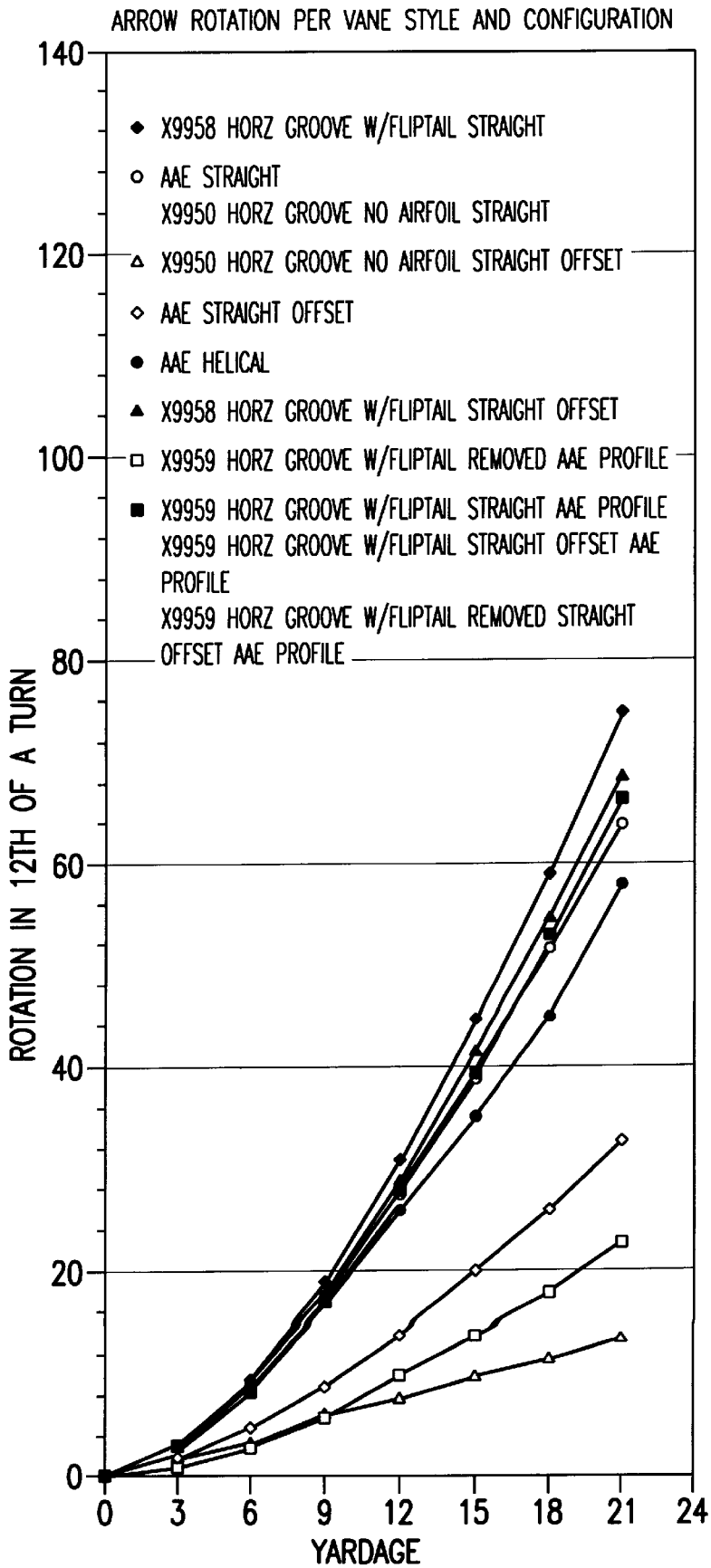
FIG. 6 is a graph showing test results performed with archery vanes according to preferred embodiments of this invention.

As shown in FIG. 5, arrow 5 comprises a plurality of archery vanes 10 having first side 12 with first surface 14 having the first surface roughness and second side 13 with second surface 15 having the second surface roughness, each mounted on arrow shaft 7 of arrow 5. Second surface 15 is roughened with respect to first surface 14. As arrow 5 is in flight, roughened second surface 15 of each archery vane 10 disturbs or interferes with the fluid flow of air. The boundary layer of fluid is disturbed as it passes over second surface 15, creating a turbulent flow that causes a lift force to act on second surface 15 of each archery vane 10. The term lift force as used throughout this specification and in the claims refers to a force acting at a right angle to the direction of motion of arrow 5 to deflect an object in a direction perpendicular to the velocity of the fluid. Preferably, arrow 5 comprises three archery vanes 10 equally spaced around the circumference of arrow shaft 7. Therefore, the lift force exerted on second surface 15 of each archery vane 10 by the fluid flow rotates arrow shaft 7 about spin axis 24. Arrow 5 rotates in a direction as shown by the arcuate arrow in FIG. 5. The angular momentum produced by the rotation provides increased rotation and increased stability of the arrow shaft and improves flight accuracy of arrow 5. Result observed during evidence testing with archery vanes 10 according to preferred embodiments of this invention are shown in the graph of FIG. 6.

The difference in roughness of second surface 15 with respect to first surface 14 must by optimized to produce a sufficient rotation and stability of arrow shaft 7 about spin axis 24 during arrow flight. At a rotational speed greater than optimal, the velocity of arrow 5 is negatively affected and the frictional drag experienced by arrow 5 is increased.

When projection 22 extends outwardly from first surface 14 of at least one archery vane 10 of arrow 5, as shown in FIG. 5, the combination of projection 22 and the second surface roughness greatly increases the rotation of arrow shaft 7 about spin axis 24 and thus increases the stability of arrow shaft 7. The result is improved flight accuracy and superior aerodynamic characteristics of arrow 5. As shown in FIG. 6, arrow 5 having a plurality of archery vanes 10 with a second surface 15 with a plurality of grooves 26 and a first surface 14 with kicker 22 rotates at a greater speed than an arrow 5 having a second surface 15 with a plurality of grooves 26 and a first surface without kicker 22.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. An archery vane comprising:

a first side having a first surface with a first surface roughness, a second side having a second surface with a second surface roughness, said first side having a first surface area within a defined boundary of the archery vane, said second side having a second surface area within said defined boundary, and said second surface roughness being greater than said first surface roughness.

2. An archery vane according to claim 1 wherein said first surface area is a first totally exposed surface area of said first surface of the archery vane.

3. An archery vane according to claim 2 wherein said second surface area is a second totally exposed surface area of said second surface of the archery vane.

4. An archery vane according to claim 1 wherein at least a portion of said second surface has a plurality of grooves.

5. An archery vane according to claim 4 wherein said grooves extend in a longitudinal direction which is generally parallel to a longitudinal axis of an arrow when the archery vane is mounted on an arrow shaft of said arrow.

6. An archery vane according to claim 1 wherein at least a portion of said second surface is roughened with respect to said first surface.

7. An archery vane according to claim 1 wherein at least a portion of said second surface has a plurality of dimples.

8. An archery vane according to claim 1 wherein at least a portion of said second surface has surface irregularities.

9. An archery vane according to claim 1 wherein at least a portion of said second surface is convex.

10. An archery vane according to claim 9 wherein said second surface is rougher than said first surface.

11. An archery vane according to claim 1 wherein said first surface is generally planar and smooth.

12. An archery vane according to claim 1 further comprising a projection extending outwardly from said first surface.

13. An archery vane according to claim 12 wherein said projection is arranged along at least a portion of a periphery of the archery vane.

14. An archery vane comprising:

a first side, a second side, said second side having a surface roughness greater than said first side, and a projection extending outwardly from said first side.

15. An archery vane according to claim 14 wherein said projection is arranged along at least a portion of a periphery of the archery vane.

* * * * *